US008439720B2

(12) United States Patent
Inoue

(10) Patent No.: US 8,439,720 B2
(45) Date of Patent: May 14, 2013

(54) SHOOTING TOY USED IN GAME FOR TWO OR MORE PLAYERS

(75) Inventor: Manabu Inoue, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 996 days.

(21) Appl. No.: 12/520,602

(22) PCT Filed: Dec. 21, 2007

(86) PCT No.: PCT/JP2007/074743

§ 371 (c)(1),
(2), (4) Date: Jun. 22, 2009

(87) PCT Pub. No.: WO2008/078713

PCT Pub. Date: Jul. 3, 2008

(65) Prior Publication Data

US 2010/0016085 A1 Jan. 21, 2010

(30) Foreign Application Priority Data

Dec. 22, 2006 (JP) ..... 2006-345456

(51) Int. Cl.
*A63H 33/00* (2006.01)
*A63B 67/00* (2006.01)
*F41G 3/26* (2006.01)

(52) U.S. Cl.
USPC ..... 446/473; 446/175; 463/39; 463/51; 434/11; 434/21

(58) Field of Classification Search ..... 446/175, 446/484; 463/49, 52–54, 39; 434/21–22
See application file for complete search history.

(56) References Cited

U.S. PATENT DOCUMENTS

| | | | | |
|---|---|---|---|---|
| 5,904,621 | A * | 5/1999 | Small et al. | 463/52 |
| 6,244,260 | B1 * | 6/2001 | Ragoza et al. | 124/34 |
| 7,338,375 | B1 * | 3/2008 | Small | 463/39 |
| 7,632,187 | B1 * | 12/2009 | Farley et al. | 463/53 |
| 7,846,028 | B2 * | 12/2010 | Small et al. | 463/51 |
| 2003/0211892 | A1 | 11/2003 | Andoh et al. | |
| 2008/0304249 | A1 * | 12/2008 | Davey et al. | 362/20 |
| 2010/0016085 | A1 * | 1/2010 | Inoue | 463/51 |

FOREIGN PATENT DOCUMENTS

| | | | |
|---|---|---|---|
| GB | 2284253 | A | 5/1995 |
| JP | U63-109897 | | 7/1988 |
| JP | 07-068050 | A | 3/1995 |
| JP | 2001-293261 | A | 10/2001 |

(Continued)

*Primary Examiner* — Dmitry Suhol
*Assistant Examiner* — Alex F. R. P. Rada, II
(74) *Attorney, Agent, or Firm* — Rankin, Hill & Clark LLP

(57) ABSTRACT

A shooting toy used in a game for two or more players capable of allowing an opponent player to reliably receive an infrared ray signal even in an open air, e.g., under a scorching sun. The intensity of light included in a particular wavelength region around a toy is detected by an optical sensor 27. If the detected amount of light included in the particular wavelength region is large, an infrared ray signal generating section 31 increases the intensity of the infrared ray signal to be generated, whereas if the detected amount of light included in the particular wavelength region is small, the infrared signal generating section 31 decreases the intensity of the infrared ray signal to be generated. This prevents the infrared ray signal reception capability from being affected by the light included in the particular wavelength region around the toy.

18 Claims, 9 Drawing Sheets

FOREIGN PATENT DOCUMENTS

| | | | |
|---|---|---|---|
| JP | 2005-349086 | A | 12/2005 |
| JP | 2006-034823 | A | 2/2006 |
| JP | 2006-207977 | A | 8/2006 |
| JP | 2008-288828 | | 11/2008 |

* cited by examiner

SHOOTING TOY USED IN GAME FOR TWO OR MORE PLAYERS

TECHNICAL FIELD

The present invention relates to a shooting toy used in a game for two or more players, with which the players enjoy shooting game by transmitting/receiving an infrared ray signal.

BACKGROUND ART

Jpn. Pat. Appln. Laid-Open Publication No. 2005-349086 (Patent Document 1) discloses an infrared ray gun which is an example of a shooting toy provided with an infrared ray signal generating section for generating an infrared ray signal for shooting and an infrared ray signal receiving section for receiving an infrared ray signal emitted from another shooting toy. In the infrared ray gun disclosed in this publication, a shot detector (infrared ray signal receiving section) has been improved so as to be able to receive (detect shot of) an infrared ray signal even in an open air, e.g., under a scorching sun as well as under an indoor environment or a darkish environment. More specifically, a reflecting mirror is provided under a downward-facing infrared ray receiving sensor provided in the shot detector (infrared ray signal receiving section) so as to allow light from the sun to be reflected outside to thereby prevent strong sunlight from directly entering the infrared ray receiving sensor. In addition, an amplifier is provided in order to amplify the output of the infrared ray receiving sensor. Further, according to this publication, a lens is provided in front of a diode for gathering an infrared ray and for emitting the infrared ray so as to expand a shot detectable distance and, when the lens is changed over to a wide-angle lens, an infrared ray emission range can be expanded to increase the hit probability against the shot detector of an enemy player.

Patent Document 1: Jpn. Pat. Appln. Laid-Open Publication No. 2005-349086

DISCLOSURE OF THE INVENTION

Problems to be Solved by the Invention

Under a scorching sun, the amount of ultraviolet ray is increased with the result that the signal intensity of the infrared ray signal is reduced due to the influence of the ultraviolet ray. Further, under an indoor environment where an incandescent bulb is used, the incandescent bulb emits an infrared ray, so that the signal intensity of the infrared ray signal is relatively reduced. Thus, the reception capability of the infrared ray signal cannot be increased only by a configuration like the conventional shooting gun disclosed in Patent Document 1 in which strong sunlight is prevented from directly entering the infrared ray receiving sensor. The configuration in which a lens is provided to gather an infrared ray can be expected to prevent to some extent the reduction in the signal intensity of the infrared ray signal due to influence of the ultraviolet ray or infrared ray emitted from the incandescent bulb. However, only under the concept like that of the technique disclosed in Patent Document 1 that the shot detectable distance is increased and the infrared ray emission range is expanded so as to increase the hit probability against the shot detector, a situation where a wide-angle lens is used under a scorching sun may occur. If the wide-angle lens is used under a scorching sun or under an environment where the incandescent light is used, the signal intensity of the infrared ray signal is reduced due to the influence of sunlight or infrared ray emitted from the incandescent bulb, so that the effect of increasing the hit probability against the shot detector cannot be obtained. Further, if the wide-angle lens is used under a scorching sun or under an environment where the incandescent light is used, not only the intensity of the infrared ray signal is reduced, but also the apparent intensity of the infrared ray signal is reduced due to the influence of infrared ray from sunlight or the incandescent bulb, with the result that a situation where a player cannot reliably transmit (irradiate the shooting toy of an opponent player with the infrared ray) the infrared ray signal to the shooting toy of an opponent player may occur.

An object of the present invention is to provide a shooting toy used in a game for two or more players capable of reliably transmitting an infrared ray signal to a shooting toy of an opponent player even in an open air, e.g., under a scorching sun or under an environment where the incandescent light is used.

Another object of the present invention is to provide a shooting toy used in a game for two or more players capable of automatically changing the intensity of an infrared ray signal to be generated in accordance with the intensity of ambient light included in a particular wavelength region.

Still another object of the present invention is to provide a shooting toy used in a game for two or more players capable of automatically changing the number of infrared ray generating elements that emit an infrared ray signal in accordance with the intensity of ambient light included in a particular wavelength region.

Still another object of the present invention is to provide a shooting toy used in a game for two or more players capable of automatically changing the radiation range of an infrared ray signal to be generated in accordance with the intensity of ambient light included in a particular wavelength region.

Means for Solving the Problem

A shooting toy used in a game for two or more players includes an infrared ray signal generating section and an infrared ray signal receiving section. The infrared ray signal generating section generates an infrared ray signal for shooting. In the case where the shooting toy is a ray gun toy, when a player operates a trigger portion of the ray gun toy, the infrared ray signal generating section generates the infrared ray signal. The infrared ray which is transmitted for giving damage to an opponent or shooting gun of an opponent serves as a virtual bullet.

The infrared ray signal receiving section receives an infrared ray signal emitted from a shooting gun of another player. The infrared ray signal receiving section may have any suitable configuration. For example, the infrared ray signal receiving section may include a receiving sensor for receiving the infrared ray signal and a signal processor for processing a signal supplied from the receiving sensor. The receiving sensor and signal processor may be provided integrally, or separately. In the case where the receiving sensor and signal processor are provided separately from each other, the receiving sensor may be fitted to a location apart from the toy main body, such as head portion or chest portion of a player. The receiving sensor may be provided in the toy main body.

In particular, the shooting toy according to the present invention includes an optical sensor that detects the intensity of light included in a particular wavelength region and outputs the detection result. The optical sensor detects the intensity of light included in a particular wavelength region around the shooting toy. The optical sensor may detect the intensity of the ambient light included in a particular wavelength range during the game constantly, periodically, or under a predetermined condition. For example, in the case where the shooting toy is a ray gun toy, the trigger portion thereof may be configured to be operated in two steps such that the intensity of the light included in a particular wavelength region is detected at the first step, and then the infrared ray signal is emitted at the second step. With this configuration, it is possible to reduce power consumption as compared to the case where the light included in a particular wavelength region is constantly measured. In particular, when a primary battery is used as a power source, the life thereof can be prolonged.

When detecting the intensity of the light included in a particular wavelength region, the optical sensor outputs the detection result to the infrared ray signal generating section. As the particular wavelength region of the light to be detector an ultraviolet ray region or visible light region may be used. In this case, an ultraviolet ray detector including an ultraviolet ray detection sensor or illuminance sensor may be used as an optical sensor. The ultraviolet ray is included in sunlight together with an infrared ray, and the higher the intensity of sunlight, the more the amounts of the ultraviolet ray and infrared ray included in sunlight. The incandescent bulb emits an infrared ray in use state, so that as the ambient illuminance is increased, the amount of the ambient infrared ray is increased. Thus, by detecting the ambient light included in a particular wavelength region, such as an ultraviolet ray or infrared ray, around the shooting toy and determining the intensity thereof, it is possible to determine the intensity of the infrared ray included in sunlight or emitted from the incandescent bulb. In other words, utilization of the output of the optical sensor allows the intensity of the light included in a particular wavelength region around the shooting toy to be grasped.

In the case where the amount of an ultraviolet ray around the shooting toy is large, or where the illuminance around the shooting toy is high, which means that the amount of an infrared ray around the shooting toy is large, so the signal intensity of the infrared ray signal emitted from the infrared ray signal generating section of the shooting toy is relatively reduced due to influence of the ambient infrared ray. In order to cope with this, in the present embodiment, the infrared ray signal generating section is configured to increase/decrease the intensity of the infrared ray signal to be generated, in accordance with the output from the optical sensor. With this configuration, when the detected intensity of the light included in a particular wavelength region is high, it is determined that the intensity of the infrared ray signal emitted from the infrared ray signal generating section of the shooting toy becomes relatively low, and the signal intensity of the infrared ray signal to be emitted from the infrared ray signal generating section is automatically increased. Conversely, when the detected intensity of the light included in a particular wavelength region is low, it is determined that the intensity of the infrared ray signal emitted from the infrared ray signal generating section of the shooting toy becomes relatively high, and the signal intensity of the infrared ray signal to be emitted from the infrared ray signal generating section is automatically decreased. As a result, the intensity of the infrared ray signal to be emitted from the infrared ray signal generating section is automatically increased/decreased in accordance with the intensity of the ambient light included in a particular wavelength region, players can play the shooting game with the same feeling without any additional operation in either an outdoor environment or an indoor environment. Further, according to the present invention, the players need not perform operation by themselves for changing the intensity of the infrared ray signal to be generated, so that even when a beginner of the shooting game plays in an open air or under influence of the infrared ray emitted from an incandescent bulb, this allows the shooting toy of an opponent player to properly receive the infrared ray signal.

Any suitable way of increasing/decreasing the intensity of the infrared ray signal in accordance with the output of the optical sensor may be employed. For example, the intensity of the infrared ray signal may be increased/decreased continuously or stepwise in proportion to the amount of the light included in a particular wavelength region detected by the optical sensor. As a result, the higher the intensity of the flight included in a particular wavelength region around the shooting toy is, that is, the more the amount of the infrared ray around the shooting gun, the higher the intensity of the infrared ray signal to be generated can be. Thus, it is possible to reliably respond to the influence of sunlight or incandescent bulb.

Further, a configuration may be adopted in which it is determined to which one of two or more level ranges that have previously been set, the intensity of the light included in a particular wavelength region detected by the optical sensor belongs and the intensity of the infrared ray signal to be generated is increased depending on the determined level range. With this configuration, it is only necessary to set the intensity of infrared ray signal for each level range, simplifying the configuration of the infrared ray signal generating section.

The infrared ray signal generating section may include a plurality of infrared ray generating elements disposed so as to emit infrared ray in the same direction and a driving device that selectively drives the infrared ray generating elements. With this configuration, when the driving device changes the number of the infrared ray generating elements to be driven in accordance with the output of the optical sensor, it is possible to simply change the intensity of the infrared ray signal to be generated in a stepwise manner.

Any suitable way of changing the number of the infrared ray generation elements to be driven in accordance with the output of the optical sensor may be employed. For example, the number of the infrared ray generation elements to be driven by the driving device may be increased/decreased in accordance with an increase or decrease of the light included in a particular wavelength region detected by the optical sensor. As a result, the higher the intensity of the light included in a particular wavelength region around the shooting toy is, that is, the more the amount of the infrared ray around the shooting gun is, the more the number of the infrared ray generation elements to be driven by the driving device can be increased. Thus, it is possible to reliably respond to the influence of sunlight or incandescent bulb.

Further, a configuration may be adopted in which it is determine to which one of two or more level ranges that have previously been set, the intensity of the light included in a particular wavelength region detected by the optical sensor belongs and the number of the infrared ray generating elements to be driven is increased depending on the determined level range. With this configuration, it is only necessary to set the number of the infrared ray generating elements to be driven for each prescribed level range, simplifying the configuration of the infrared ray signal generating section.

Further, the infrared ray signal generating section according to the present embodiment may include an irradiation range controlling section that control the irradiation range of the infrared ray signal. The irradiation range controlling section controls the irradiation range of the infrared ray signal in accordance with the output of the optical sensor. When the irradiation range controlling section is used to collect the infrared ray signal in a narrow irradiation range, the intensity of the infrared ray signal within the irradiation range can be increased. A lens having a zoom function capable of optically controlling is used as an irradiation range controlling section. Further, an irradiation range controlling section having a mechanical structure may be disposed near the output port of the irradiation path of the infrared ray signal so as to surround the irradiation path. In this case, the irradiation range controlling section mechanically changes the cross section of the irradiation path.

Any suitable way of controlling the irradiation range of the infrared ray signal in accordance with the output of the optical sensor may be employed. For example, the irradiation range may be controlled such that it is narrowed when the intensity of the light included in a particular wavelength region detected by the optical sensor is increased, while it is widened when the intensity thereof is decreased. Further, the irradiation range controlling section may be configured to determine to which one of two or more level ranges that have previously been set, the amount of the light included in a particular wavelength region detected by the optical sensor belongs and narrow the irradiation range depending on the determined level range. With this configuration, it is only necessary to set the irradiation range of the infrared ray signal for each prescribed level range, simplifying the configuration of the infrared ray signal generating section.

The infrared ray signal generating section may include both the driving device that selectively drives the plurality of infrared ray generating elements disposed so as to emit infrared ray in the same direction and the irradiation range controlling section.

The present invention is summarized as follows.

(1) A shooting toy used in a game for two or more players comprising: an infrared ray signal generating section that generates an infrared ray signal for shooting: an infrared ray signal receiving section that receives an infrared ray signal generated by a shooting toy of a opponent player; and an optical sensor that detects the intensity of light included in a particular wavelength region and outputs a detection result, the infrared ray signal generating section including a plurality of infrared ray generating elements disposed to emit the infrared ray in the same direction and a driving device that selectively drives the plurality of infrared ray generating elements, and the driving device of the infrared ray signal generating section being configured to increase or decrease the number of infrared ray generating elements to be driven according to the output from the optical sensor.

(2) The shooting toy used in a game for two or more players according to (1), wherein the driving devices increase or decrease the number of the infrared ray generating elements to be driven according to an increase or decrease in the intensity of the light included in the particular wavelength region detected by the optical sensor.

(3) The shooting toy used in a game for two or more players according to (1), wherein the driving device determines which range of level the intensity of the light included in the particular wavelength region falls in among predetermined two or more ranges of level, and increases the number of the infrared ray generating elements to be driven according to the determined level range.

(4) The shooting toy used in a game for two or more players according to (1), wherein the infrared ray signal generating section further includes an irradiation range controlling section that controls the irradiation range of the infrared ray signal, and the irradiation range controlling section is configured to control the irradiation range of the infrared ray signal according to the output from the optical sensor.

(5) The shooting toy used in a game for two or more players according to (4), wherein the irradiation range controlling section narrows the irradiation range when the intensity of the light included in the particular wavelength region detected by the optical sensor increases, and widens the irradiation range when the intensity of the light included in the particular wavelength region detected by the optical sensor decreases.

(6) The shooting toy used in a game for two or more players according to (4), wherein the irradiation range controlling section determines which level range the intensity of the light included in the particular wavelength region detected by the optical sensor falls in among predetermined two or more level ranges, and narrows the irradiation range according to the determined level range.

(7) A shooting toy used in a game for two or more players comprising: an infrared ray signal generating section that generates an infrared ray signal for shooting: an infrared ray signal receiving section that receives an infrared ray signal generated by a shooting toy of a different player; and an optical sensor that detects the intensity of light included in a particular wavelength region and outputs a detection result, the infrared ray signal generating section including an irradiation range controlling section that controls the irradiation range of the infrared ray signal, and the irradiation range controlling section of the infrared ray signal generating section being configured to control the irradiation range of the infrared ray signal according to the output from the optical sensor.

(8) The shooting toy used in a game for two or more players according to (7), wherein the irradiation range controlling section narrows the irradiation range when intensity of the light included in the particular wavelength region detected by the optical sensor increases, and widens the irradiation range when the intensity of the light included in the particular wavelength region detected by the optical sensor decreases.

(9) The shooting toy used in a game for two or more players according to (7), wherein the irradiation range controlling section determines which level range the intensity of the light included in the particular wavelength region falls in among predetermined two or more Level ranges, and narrows the irradiation range according to the determined level range.

(10) A shooting toy used in a game for two or more players including: an infrared ray signal generating section that generates an infrared ray signal for shooting: an infrared ray signal receiving section that receives an infrared ray signal generated by a shooting toy of a different player; and an optical sensor that detects the intensity of light included in a particular wavelength region and outputs a detection result, the infrared ray signal generating section being configured to increase or decrease the intensity of the infrared ray signal according to the output from the optical sensor.

(11) The shooting toy used in a game for two or more players according to (10), wherein the infrared ray signal generating section increases or decreases the intensity of the infrared ray signal according to an increase or decrease in the intensity of the light included in the particular wavelength region detected by the optical sensor.

(12) The shooting toy used in a game for two or more players according to (10), wherein the infrared ray signal generating section determines which level range the intensity of the light included in the particular wavelength region falls in among predetermined two or more level ranges, and increases an intensity of the infrared ray signal according to the determined level range.

(13) The shooting toy used in a game for two or more players according to (1) to (12), wherein the optical sensor is an ultraviolet ray detector including an ultraviolet ray detection sensor, and the light included the particular wavelength region is ultraviolet ray.

(14) The shooting toy used in a game for two or more players according to (1) to (12), wherein the optical sensor is an illuminance sensor, and the light included in the particular wavelength region is visible light.

BEST MODE FOR CARRYING OUT THE INVENTION

Figure 1:
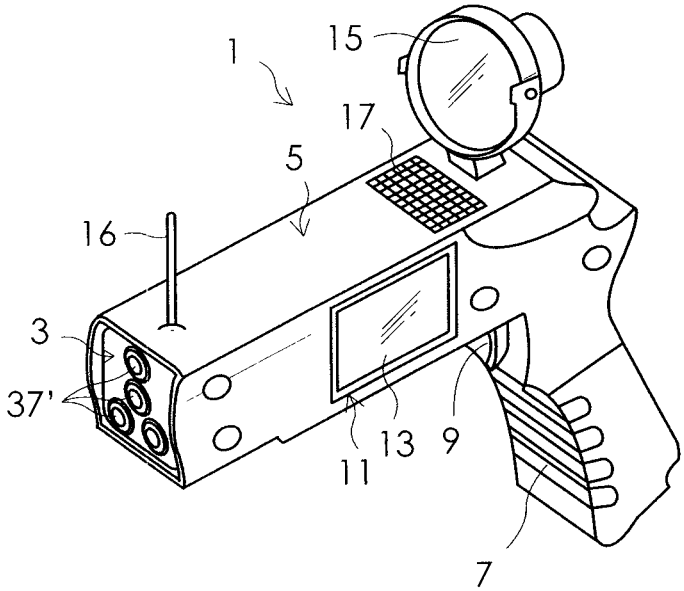
FIG. 1 is a perspective view showing a ray gun toy according to an embodiment of the present invention.
Figure 2A:
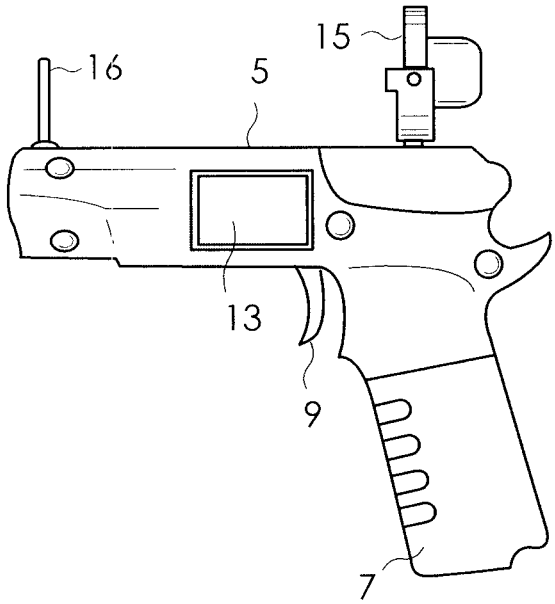
FIGS. 2(A) and 2(B) are right side and front views of the ray gun toy according to the present embodiment and FIG. 2(C) is a rear side view thereof in a state where a display section is raised up.
Figure 2B:
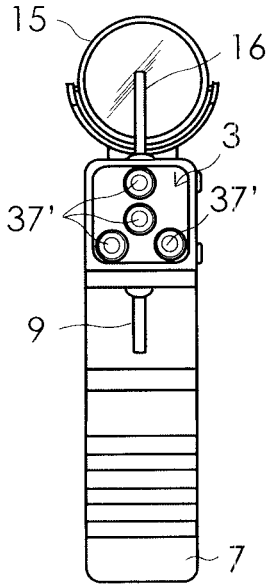
Figure 2C:
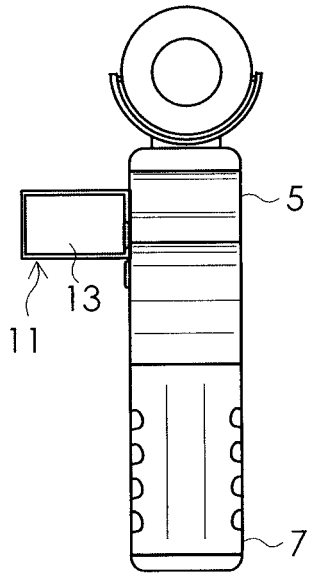
Figure 3:
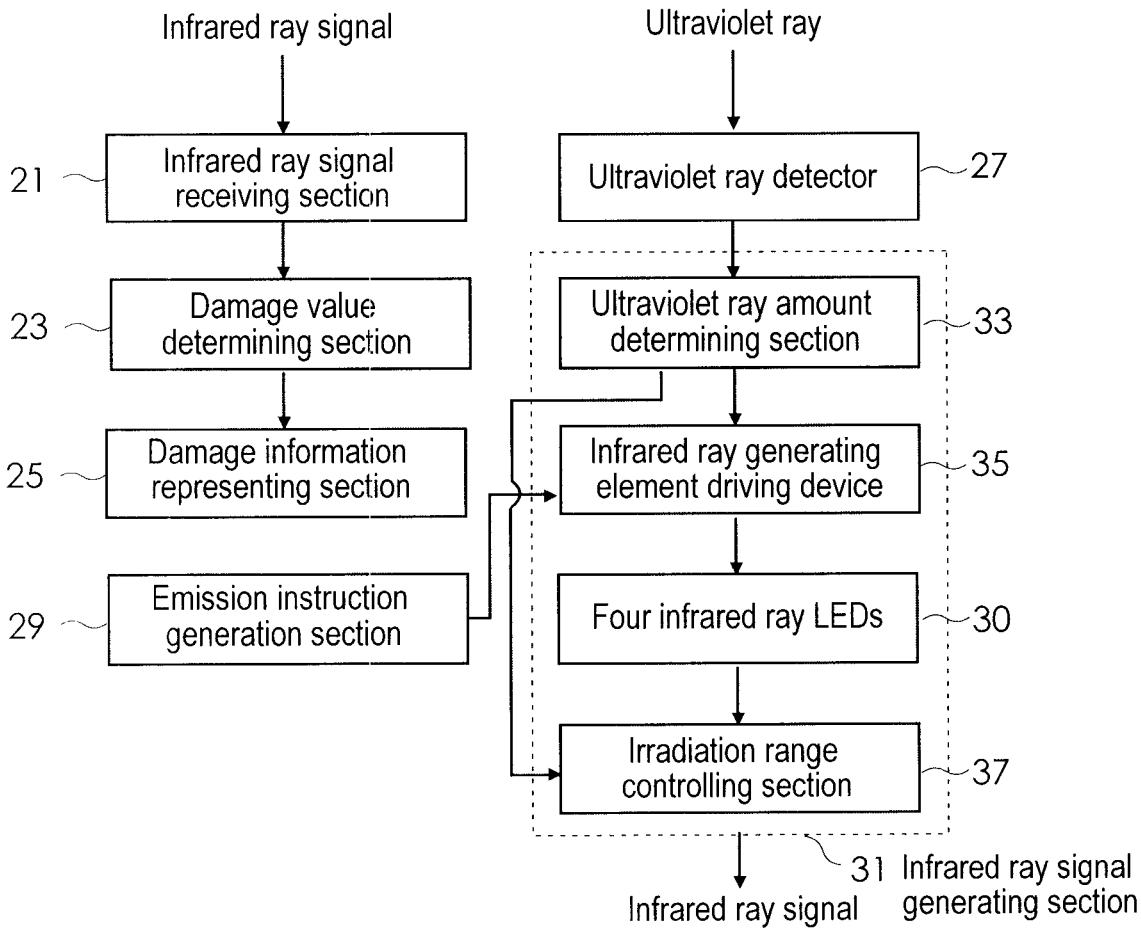
FIG. 3 is a block diagram showing an example of a configuration of a main part of the ray gun toy 1 according to the present embodiment.

An embodiment of a shooting toy used in a game for two or more players will be described with reference to the accompanying drawings. FIG. 1 is a perspective view showing an example of an embodiment in which the shooting toy according to the present embodiment is applied to a ray gun toy. FIGS. 2(A) and 2(B) are right side and front views of the ray gun toy 1 of FIG. 1 and FIG. 2(C) is a rear side view thereof in a state where a display section is raised up. FIG. 3 is a block diagram showing an example of a configuration of the main body of a signal processing circuit incorporated in a gun main body 5 of the ray gun toy 1. As shown in FIGS. 1 and 2, the ray gun toy 1 includes a gun main body 5 having, at its one end, an infrared ray signal generating means 3 that emits an infrared ray signal and a grip portion 7 provided at the lower portion of the other end of the gun main body 5. An infrared ray LED may be used as an infrared ray generating element of the infrared ray signal generating means 3. The infrared ray signal generating means 3 includes four infrared ray LEDs 30 (FIG. 3) and an infrared ray generating element driving device 35 (FIG. 3) that is disposed inside the gun main body 5 and controls current to be supplied to the infrared ray LEDs to thereby control emission of the infrared ray LEDs. The infrared ray generating means 3 shown in FIGS. 1 and 2(B) includes a zoom lens 37' having a zoom function used as an irradiation range controlling section 37 (FIG. 3). The zoom lens 37' is used for optically controlling the irradiation angle of an infrared ray signal. Various electrical components including the infrared ray LEDs and a signal processing means are incorporated inside the gun main body 5. Although four infrared ray LEDs are used as infrared ray generating elements of the infrared ray generating means 3 in the present embodiment, the number of the infrared ray LEDs is not limited to four.

A trigger portion 9 operated by a forefinger of a player who holds the grip portion 7 is provided at the lower portion of the gun main body 5 near the grip portion 7. A concave portion (not shown) for housing an image display section 11 is formed in one side wall of the gun main body 5. The image display section 11 is fixed to the gun main body 5 by a hinge provided at one side of the image display section 11 on the grip portion 7 side. In the example shown in FIG. 1, FIG. 2(A) and FIG. 2(B), the image display section 11 is housed in the concave portion. In a state shown in FIG. 2(C), the image display section 11 is pivoted upon the hinge to be raised up perpendicular to the gun main body 5. That is, in a state shown in FIG. 2(C), a player holding the grip portion 7 with his hand can view a screen 13 of the image display section 11 during fight. An infrared ray signal receiving means 15 that receives an infrared ray signal emitted from the ray gun toy 1 of another player is fixed to the upper wall portion at the other end of the gun main body 5. An infrared ray signal receiving section 21 (FIG. 3) that includes an infrared ray sensor for receiving an infrared ray signal and converts the infrared ray signal into an electrical signal so as to output the electrical signal is provided in the infrared ray signal receiving means 15.

In the present embodiment, an ultraviolet region is set as a particular wavelength region and the light intensity of the ultraviolet region is detected. As an optical sensor, an ultraviolet ray detector 27 is used. The ultraviolet ray detector 27 (FIG. 3) including an ultraviolet ray detection sensor for detecting an ultraviolet ray around the ray gun toy 1 is provided in the infrared ray signal receiving means 15 together with the infrared ray signal receiving section 21 (FIG. 3). Thus, the infrared ray signal receiving means 15 functions also as the ultraviolet ray detection sensor. Although the ultraviolet ray detector including the ultraviolet ray detection sensor and the infrared ray signal receiving section are provided together in the infrared ray signal receiving means 15 in the present embodiment, they may be provided separately in different portions. When detecting an ultraviolet ray around the ray gun toy, the ultraviolet ray detector 27 converts the detected ultraviolet ray into an electrical signal and transmits it to an ultraviolet ray amount determining section 33 to be described later. A sound emitting section 17 that emits sound from a speaker incorporated in the gun main body 5 is provided in the upper wall of the gun main body 5. Further, an antenna 16 that transmits/receives a radio signal is provided at the leading end of the gun main body 5. In the present embodiment, a radio signal including identifier is transmitted from the antenna 16 and, based on the identifier, each of the ray gun toys identifies existence of other players.

Next, a configuration of the main part of the signal processing circuit shown in FIG. 3 will be described. Note that a radio signal processing circuit for transmitting/receiving a radio signal through the antenna 16 is not shown in the signal processing circuit shown in FIG. 3. The signal processing circuit includes the infrared ray signal receiving section 21 that receives an infrared ray signal emitted from an opponent through the infrared ray signal receiving means 15 and then applies signal processing to the received signal. The infrared ray signal receiving section 21 has a function of converting the received infrared ray signal into an electrical signal. When receiving the infrared ray signal, the infrared ray signal receiving section 21 outputs the converted electrical signal to a damage value determining section 23.

When receiving the electrical signal output from the infrared ray signal receiving section 21, the damage value determining section 23 determines a damage value. The damage value may be determined in a suitable manner. For example, the value of damage caused by receiving the infrared ray signal may be set constant. Further, in the case where the infrared ray signal includes the identifier, the damage value may be determined on a per received infrared signal basis or may be changed based on the examination result of the identifier. The damage value determined by the damage value determining section 23 is input to a damage information representing section 25 so as to be represented outside. The damage information may be represented in a suitable manner. In the present embodiment, the damage information is displayed on the screen 13 (FIG. 1) so as to be visually confirmed. Further, a speaker is driven to output a sound effect from the sound emitting section 17 (FIG. 1) so as to allow the damage information to be aurally confirmed. Further, in the present embodiment, a not shown vibration generating means is provided inside the grip portion 7 so as to allow the damage information to be tactually confirmed. By providing the damage information representing section 25 having such a configuration, it is possible for a player to easily confirm the damage information, thereby increasing the sense of thrill enjoyed by the player during the game.

The signal processing section further includes an ultraviolet ray detector 27 serving as an optical sensor, an emission instruction generation section 29, and an infrared ray signal generating section 31. The infrared ray signal generating section 31 includes the ultraviolet ray amount determining section 33, infrared ray generating element driving device 35, and four infrared ray LEDs 30, and irradiation range controlling section 37.

The ultraviolet ray detector 27 includes an ultraviolet detection sensor for detecting an ultraviolet ray around the ray gun toy 1. In the present embodiment, the infrared ray signal receiving means 15 has a function of detecting an ultraviolet ray. The ultraviolet ray detector 27 has a function of converting the detected ultraviolet ray into an electrical signal. After detection and conversion of the ultraviolet ray, the ultraviolet ray detector 27 outputs the converted electrical signal to the ultraviolet ray amount determining section 33. An ultraviolet ray is included in sunlight together with an infrared ray signal. The higher the intensity of sunlight, the more the amounts of the ultraviolet ray and infrared ray included in sunlight Accordingly, by detecting the ultraviolet ray around the ray gun toy 1 to determine the amount thereof, it is possible to relatively determine the amount of the infrared ray included in sunlight.

The ultraviolet ray detector 27 used in the present embodiment constantly detects the amount of the surrounding ultraviolet ray during the game. Alternatively, however, the ultraviolet ray detector 27 may detect the amount of the ultraviolet ray periodically or under a predetermined condition. The predetermined condition includes, e.g., that ultraviolet ray detector 27 detects the ultraviolet ray immediately before the emission instruction generation section 29 outputs an emission instruction to the infrared ray generating element driving device 35. More specifically, in this case, the trigger portion 9 is operated in two steps. The amount of the ultraviolet ray is detected at the first step, and then the infrared ray signal is emitted at the second step. With this configuration, it is possible to reduce power consumption as compared to the case where the amount of the ultraviolet ray is constantly measured. In particular, when a primary battery is used as a power source, the life thereof can be prolonged.

The ultraviolet ray amount determining section 33 determines the amount of the ultraviolet ray detected by the ultraviolet ray detector 27. The infrared ray signal emitted from the ray gun toy 1 undergoes influence of sunlight including the ultraviolet ray and infrared ray before it has been received by the ray gun toy 1 of another player and is reduced in intensity. As described above, the ultraviolet ray is included in sunlight together with an infrared ray, and the higher the intensity of sunlight, the more the amounts of the ultraviolet ray and infrared ray included in sunlight. Thus, by detecting the ultraviolet ray around the ray gun toy 1 to determine the amount thereof, it is possible to determine the intensity of sunlight around the ray gun toy 1, i.e., the amount of the infrared ray included in sunlight. That is, by utilizing the determination result of the ultraviolet ray amount determining section 33, it is possible to detect how much the infrared ray signal emitted from the ray gun toy 1 is affected by the ultraviolet ray and infrared ray included in sunlight before it has been received by the ray gun toy 1 of another player. In the present embodiment, the determination result of the ultraviolet ray amount determining section 33 is supplied to the infrared ray generating element driving device 35 and irradiation range controlling section 37.

Concretely, the ultraviolet ray amount determining section 33 according to the present embodiment determines, based on the output of the ultraviolet ray detector 27, the parameter value used for changing the infrared ray signal (to be generated. In the present embodiment, in order to change the intensity of the infrared ray signal to be emitted in accordance with the determined parameter value, the number of the infrared ray LEDs 30 driven by the infrared ray generating element driving device 35 is determined, the intensity of the infrared ray signal output from each infrared ray LED30 is increased/decreased, or the zoom lens 37' is driven to control the irradiation range of the infrared ray signal output from each infrared ray LED 30.

The ultraviolet ray amount determining section 33 may determine the parameter value in a suitable manner. For example, the ultraviolet ray amount determining section 33 may determine the parameter value continuously or stepwise in proportion to the amount of the ultraviolet ray output from the ultraviolet ray detector 27. As a result, the more the detected amount of the ultraviolet ray, that is, the higher the intensity of the detected ultraviolet ray, the higher the intensity of the infrared ray signal to be generated can be. Further, the ultraviolet ray amount determining section 33 may be configured to determine to which one of two or more level ranges that have previously been set, the amount of the ultraviolet ray output from the ultraviolet ray detector 27 belongs and determine the parameter value depending on the determined level range. With this configuration, it is only necessary to set the parameter value for each level range, simplifying the configuration of the ultraviolet ray amount determining section 33.

At any rate, when the parameter value used in the determination of the intensity of the infrared ray signal to be generated is changed in accordance with the determination result of the ultraviolet ray amount determining section 33, it is possible to increase the intensity of the infrared ray signal to be generated to such a degree that the shooting toy of an opponent player can properly receive the generated infrared ray, even if the infrared ray signal is affected by the ultraviolet ray or infrared ray from sunlight. Thus, even if the shooting game is played in an open air, e.g., under a scorching sun, players can play the game with the same feeling as in the case where they play the game, e.g., under an indoor environment without any particular additional operation.

In the present embodiment, the signal processing circuit includes an emission instruction generating section 29 that outputs an emission instruction when the trigger portion 9 of FIG. 1 is operated. When the emission instruction is output from the emission instruction generating section 29, the infrared ray generating element driving device 35 of the infrared ray signal generating section 31 is activated so as to cause the infrared ray signal generating means 3 of FIG. 1 to generate the infrared ray signal. The infrared ray generating element driving device 35 drives the four infrared ray LEDs 30 so as to cause them to output the infrared ray signal of a predetermined frequency only during reception of the emission instruction. The infrared ray generating element driving device 35 may stop the output of the infrared ray signal after outputting the infrared ray signal by a predetermined time after reception of one emission instruction, or may output the infrared ray signal continuously or intermittently while receiving the emission instruction. The infrared ray signal serves as a virtual bullet emitted or transmitted for giving damage to an opponent or shooting gun toy of an opponent.

In the present embodiment, in order to change the intensity of the infrared ray signal by utilizing the determination result of the ultraviolet ray amount determining section 33, the number of the infrared ray LEDs 30 serving as infrared ray generating element to be driven is increased, the amount of drive current to be supplied to the infrared ray LEDs 30 is increased, or the zoom lens 37' is driven to control the irradiation range of the infrared ray signal.

For example, when the intensity of the infrared ray signal to be generated is changed by changing the number of the infrared ray generating element to be driven based on the determination result of the ultraviolet ray amount determining section 33, the infrared ray generating element driving device 35 is configured to increase the number of the infrared ray LEDs 30 to be driven in proportion to the determination result of the ultraviolet ray amount determining section 33 in a stepwise manner. Further, a configuration may be adopted in which the ultraviolet ray amount determining section 33 determines to which one of two or more level ranges that have previously been set the amount of the ultraviolet ray detected by the ultraviolet ray detector 27 belongs and the infrared ray generating element driving device 35 determines the number of the infrared ray generating element to be driven depending on the determined level range.

The determination result of the ultraviolet ray amount determining section 33 is input to the irradiation range controlling section 37. In the present embodiment, a zoom lens 37' having a zoom function capable of optically controlling the irradiation range of the infrared ray signal emitted from the infrared ray generating element is used as the irradiation range controlling section 37. The zoom lens 37' is disposed in front of the direction in which the infrared ray LED 30 emits the infrared ray. By chancing the zoom amount of the zoom lens 37', the irradiation range of the infrared ray signal emitted through the zoom lens 37' is controlled. The irradiation range controlling section 37 determines the irradiation range based on the determination result of the ultraviolet ray amount determining section 33, i.e., parameter value. The irradiation range controlling section 37 may control the irradiation range in a suitable manner. In the present embodiment, the irradiation range controlling section 37 controls the zoom lens 37' such that the irradiation range is narrowed when the amount of the ultraviolet ray determined by the ultraviolet ray amount determining section 33 is increased, while the irradiation range is widened when the amount of the ultraviolet ray is decreased. As a result, the more the amount of the detected ultraviolet ray, the narrower the irradiation range of the infrared ray signal. In other words, the infrared ray signal can be collected in the narrower irradiation range, making it possible to further increase the intensity of the infrared ray signal within the irradiation range. The irradiation range may be set depending on the level range determined by the ultraviolet ray amount determining section 33.

Although the four infrared ray LEDs 30, infrared ray generating element driving device 35, and irradiation range controlling section 37 are provided in the present embodiment, the irradiation range controlling section 37 may be omitted. In this case, changing the number of the infrared ray LEDs 30 to be driven by the infrared ray generating element driving device 35 is just enough to change the intensity of the infrared ray. Further, only one of the four infrared ray LEDs 30 may be used. In this case, the irradiation range controlling section 37 controls the irradiation range of the one infrared ray LED 30 so as to change the intensity of the infrared ray, or drive current to be supplied to the one infrared ray LED 30 is controlled so as to change the intensity of the infrared ray to be generated from the infrared ray LED 30.

Although the zoom lens 37' is used as the irradiation range controlling section 37 in the above embodiment, the irradiation range controlling section 37 may have any configuration as long as it has a function of collecting the infrared ray signal in the narrow irradiation range. For example, an irradiation range controlling section having a mechanical structure may be disposed near the output port of the irradiation path of the infrared ray signal so as to surround the irradiation path. In this case, the irradiation range controlling section mechanically changes the cross section of the irradiation path.

Figure 4:
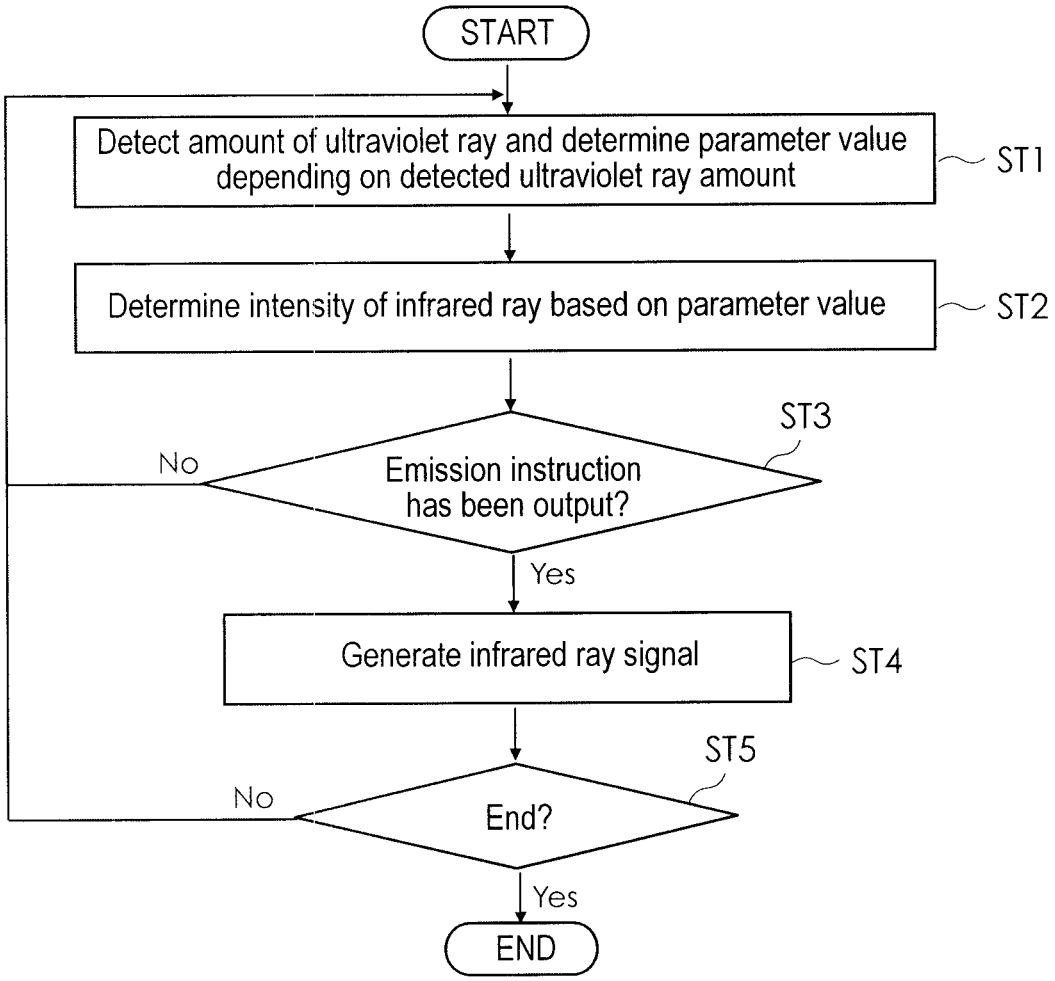
FIG. 4 is a flowchart showing an algorithm of a program used when the intensity of an infrared ray signal is changed.

FIG. 4 is a flowchart showing an example of an algorithm of software that can be used for changing the intensity of the infrared ray signal to be generated in the case where the signal processing circuit of FIG. 3 is realized using a microcomputer. In this algorithm, the ultraviolet ray detector 27 detects the amount of the ultraviolet ray around the ray gun toy 1. The ultraviolet ray detector 27 detects the ultraviolet ray constantly, and the ultraviolet ray amount determining section 33 consecutively receives an electrical signal from the ultraviolet ray detector 27 and determines the amount of the ultraviolet ray. The ultraviolet ray amount determining section 33 then determines a parameter value based on the detected amount of the ultraviolet ray (step ST1). Based on the determined parameter value, the ultraviolet ray amount determining section 33 then determines the intensity of the infrared ray signal to be generated (step ST2). Then, it is determined whether an emission instruction has been output step ST3). That is, it is determined in step ST3 whether a player has operated the trigger portion 9 so as to allow the emission instruction generating section 29 to output an emission signal. When it is determined in step ST3 that the emission instruction has not been output, the flow returns to step ST1 where the detection processing of the ultraviolet ray is performed. On the other hand, when it is determined in step ST3 that the emission instruction has been output, the flow advances to step ST4, where an infrared ray signal is emitted from the infrared ray signal generating section 31. After the output of the infrared ray signal in step ST4, the flow advances to step ST5, where it is determined whether a certain condition has been satisfied or whether a player has input information indicating the end of the game. When the input has not been made, the flow returns to step ST1, where the detection processing of the ultraviolet ray is performed once again. When the input has been made, the game is ended. Any algorithm may be adopted as long as the parameter value can be changed depending on the amount of the ultraviolet ray.

Figure 5:
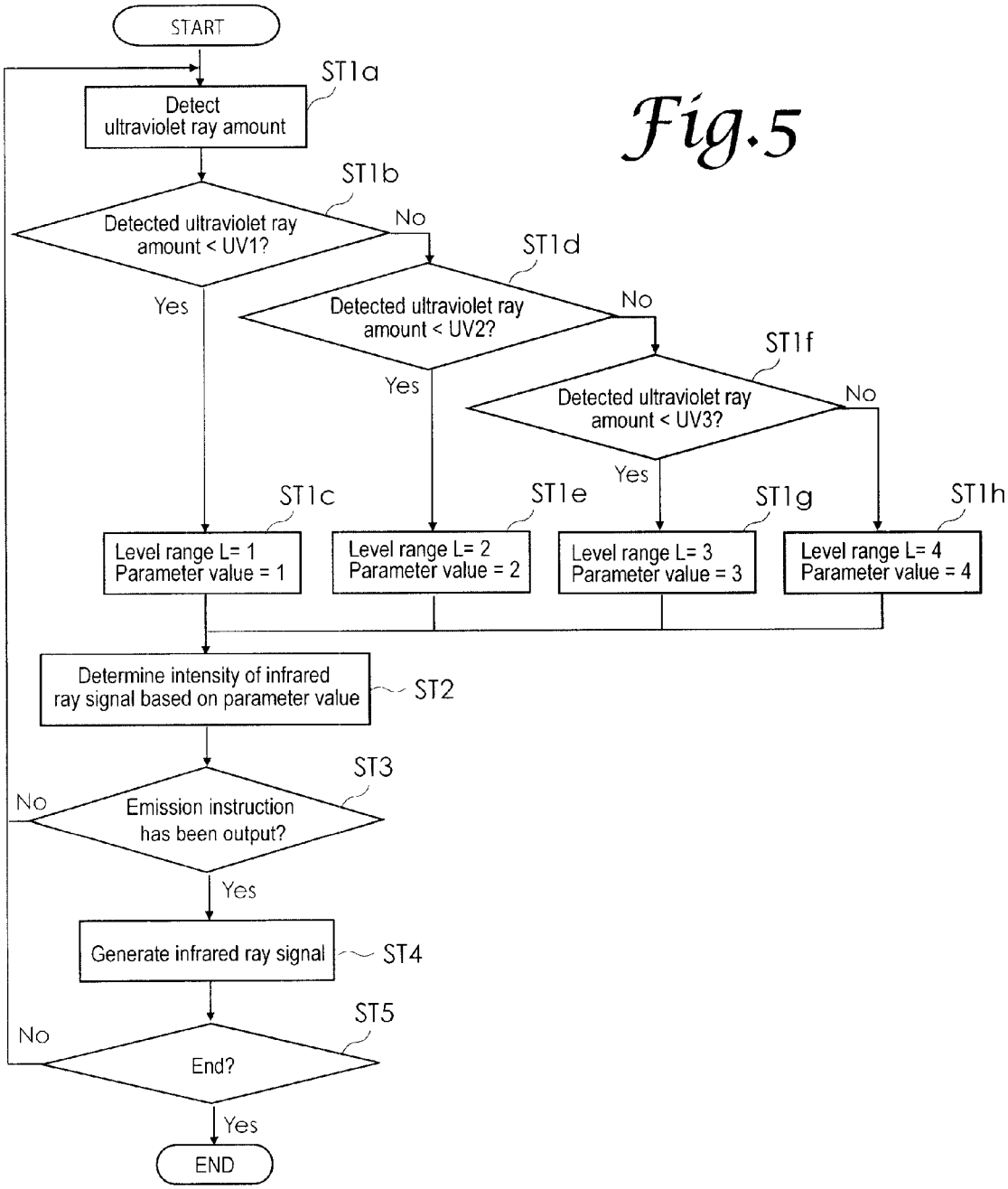
FIG. 5 is a flowchart for explaining a part of the flowchart of FIG. 4 in more detail.

FIG. 5 is a flowchart for explaining in more detail the algorithm of FIG. 4, wherein in step ST1, it is determined to which one of two or more level ranges that have previously been set the amount of the ultraviolet ray detected by the ultraviolet ray detector 27 belongs and the intensity of the infrared ray signal is increased depending on the determined level range. Thus, the detail of only step ST1 will be described below. In step ST1*a*, the ultraviolet ray detector 27 detects the ultraviolet ray around the ray gun toy 1. It is assumed here that the intensity of the infrared ray signal to be generated is divided into four levels. In step STb1, it is determined whether the amount of the ultraviolet ray detected is less than a prescribed ultraviolet ray amount UV1. When the amount of the ultraviolet ray is less than the UV1, the level range of the intensity of the ultraviolet ray is determined to be 1 (L=1), and the parameter value is set to 1 (step ST1*c*). When the amount of the ultraviolet ray is not less than the prescribed UV1, the flow advances to step ST1*d*. In step ST1*d*, it is determined whether the amount of the ultraviolet ray detected is less than a prescribed ultraviolet ray amount UV2. When the amount of the ultraviolet ray is less than the UV2, the level range of the intensity of the ultraviolet ray is determined to be 2 (L=2), and the parameter value is set to 2 (step ST1*e*). When the amount of the ultraviolet ray is not less than the UV2, the flow advances to step ST1*f*. In step ST1*f*, it is determined whether the amount of the ultraviolet ray detected is less than a prescribed ultraviolet ray amount UV3. When the amount of the ultraviolet ray is less than the UV3, the level range of the intensity of the ultraviolet ray is determined to be 3 (L=3), and the parameter value is set to 3 (step ST1*g*). When the amount of the ultraviolet ray is not less than the UV3, the flow advances to step ST1H, where the level range of the intensity of the ultraviolet ray is determined to be 4 (L=4), and the parameter value is set to 4. In step ST2, the intensity of the infrared ray is determined based on the parameter value corresponding to the determined level range.

Figure 6:
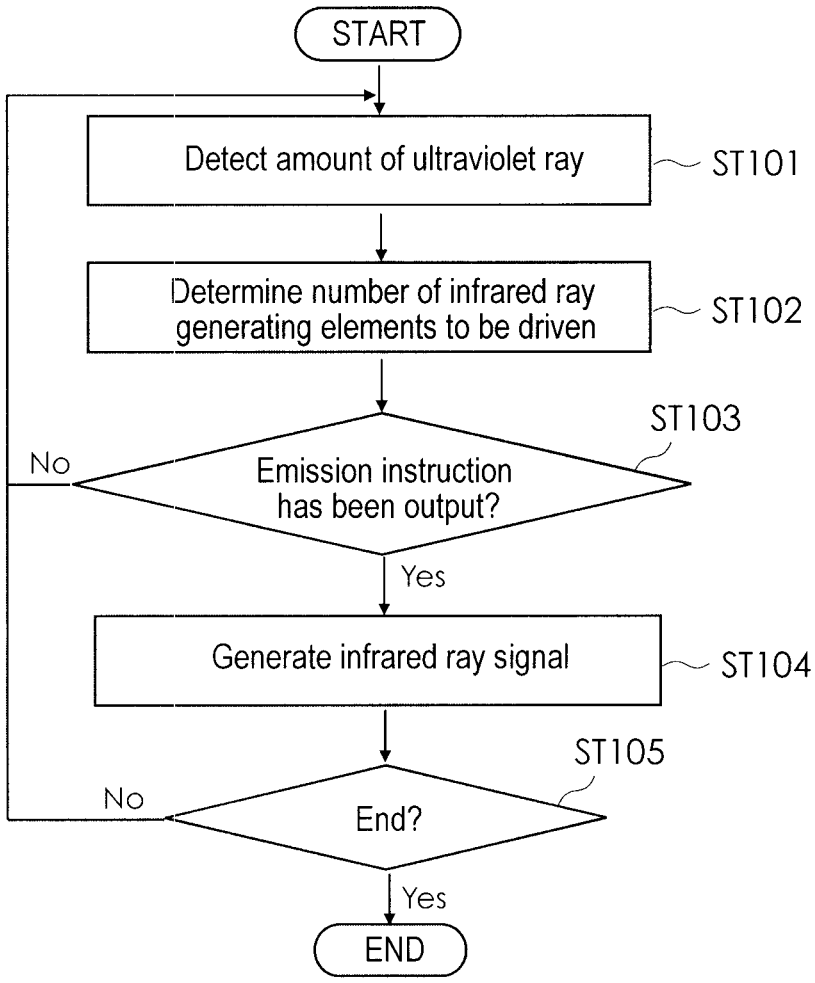
FIG. 6 is a flowchart showing an algorithm of a program used for changing the number of the infrared ray generating elements to be driven.

FIG. 6 is a flowchart showing an algorithm of software used for changing the number of the infrared ray generating elements (infrared ray LEDs) to be driven in the case where a plurality of the infrared ray signal generating elements are disposed so as to emit the infrared ray in the same direction. Firstly the ultraviolet ray detector 27 detects the amount of the ultraviolet ray around the ray gun toy 1 (step ST101). The ultraviolet ray detector 27 detects the ultraviolet ray constantly, and the ultraviolet ray amount determining section 33 consecutively receives an electrical signal from the ultraviolet ray detector 27 and determines the amount of the ultraviolet ray. Then, the infrared ray generating element driving device 35 determines the number of the infrared ray generating elements to be driven based on the determination result of the ultraviolet ray amount determining section 33 (step ST102). Then, it is determined whether an emission instruction has been output (step ST103). When it is determined in step ST103 that the emission instruction has not been output, the flow returns to step ST101 where the detection processing of the ultraviolet ray is performed. The processing from step ST103 to step ST105 is the same as the processing from step ST3 to step ST5 of FIG. 4, so the description thereof is omitted here.

Figure 7:
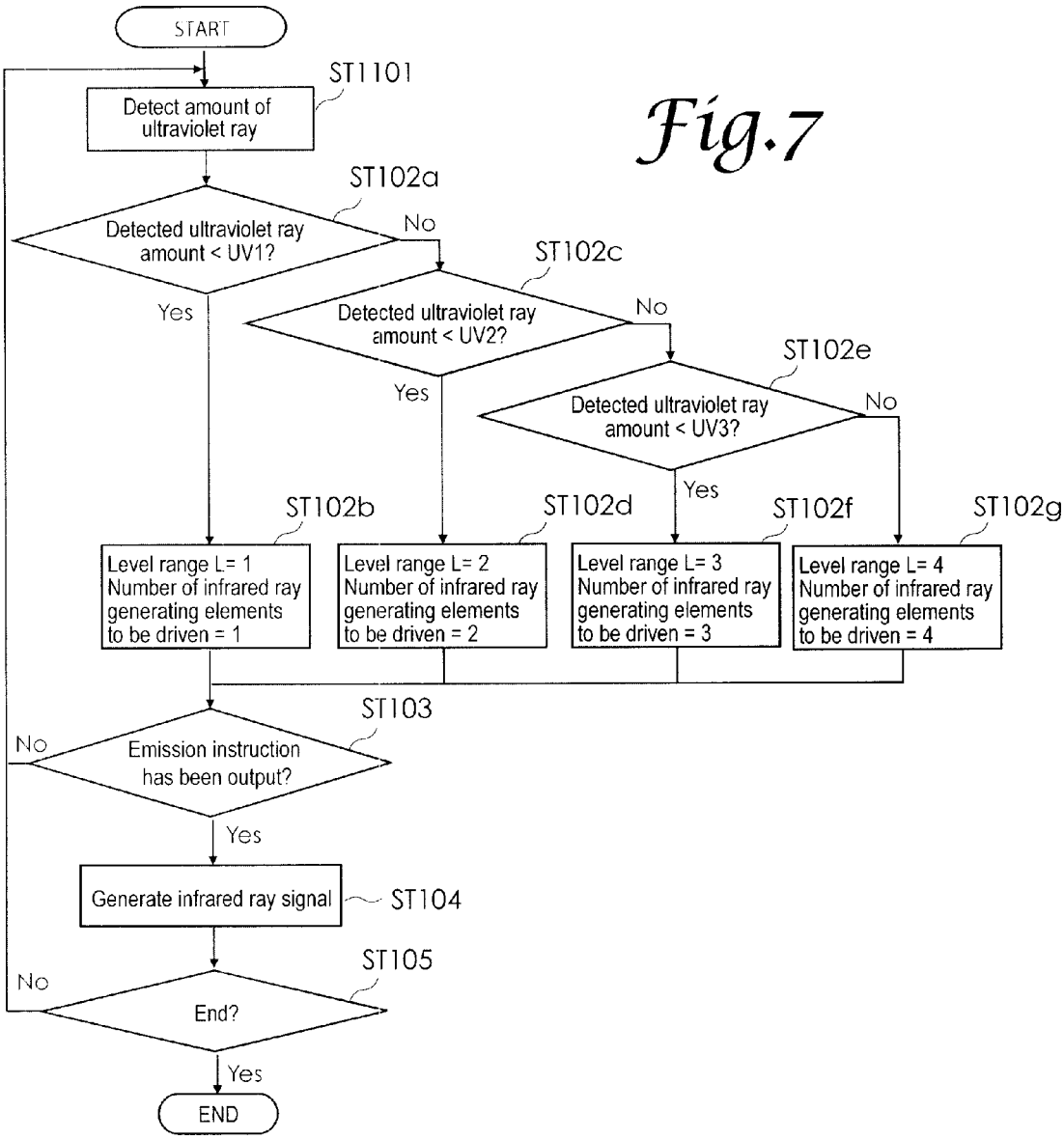
FIG. 7 is a flowchart for explaining a part of the flowchart of FIG. 6 in more detail.

FIG. 7 is a flowchart for explaining in more detail the algorithm of FIG. 6, wherein in step ST102, it is determined to which one of two or more level ranges that have previously been set the amount of the ultraviolet ray detected by the ultraviolet ray detector 27 belongs and the number of the infrared ray generating elements (infrared ray LEDs 30) to be driven depending on the determined level range is determined. Thus, the detail of only step ST102 will be described below. It is assumed here that the ray gun toy 1 has four infrared ray generating elements (infrared ray LEDs 30). In step ST101, the ultraviolet ray detector 27 detects the amount of the ultraviolet ray around the ray gun toy 1. In step ST102*a*, it is determined whether the amount of the ultraviolet ray detected is less than a prescribed ultraviolet ray amount UV1. When the amount of the ultraviolet ray is less than the UV1, the level range of the intensity of the ultraviolet ray is determined to be 1 (L=1), and the number of the infrared ray generating element to be driven is set to 1 (step ST102*b*). When the amount of the ultraviolet ray is not less than the UV1, the flow advances to step ST102*c*. In step ST102*c*, it is determined whether the amount of the ultraviolet ray detected is less than a prescribed ultraviolet ray amount UV2. When the amount of the ultraviolet ray is less than the UV2, the level range of the intensity of the ultraviolet ray is determined to be 2 (L=2), and the number of the infrared ray generating element to be driven is set to 2 (step ST102*d*). When the amount of the ultraviolet ray is not less than the UV2, the flow advances to step ST102*e*. In step ST102*e*, it is determined whether the amount of the ultraviolet ray detected is less than a prescribed ultraviolet ray amount UV3. When the amount of the ultraviolet ray is less than the UV3, the level range of the intensity of the ultraviolet ray is determined to be 3 (L=3), and the number of the infrared ray generating element to be driven is set to 3 (step ST102*f*). When the amount of the ultraviolet ray is not less than the UV3, the flow advances to step ST102*g*, where the level range of the intensity of the ultraviolet ray is determined to be 4 (L=4), and the number of the infrared ray generating element to be driven is set to 4. The processing from step ST103 to step ST105 is the same as the processing from step ST3 to step ST5 of FIG. 4, so the description thereof is omitted here.

Figure 8:
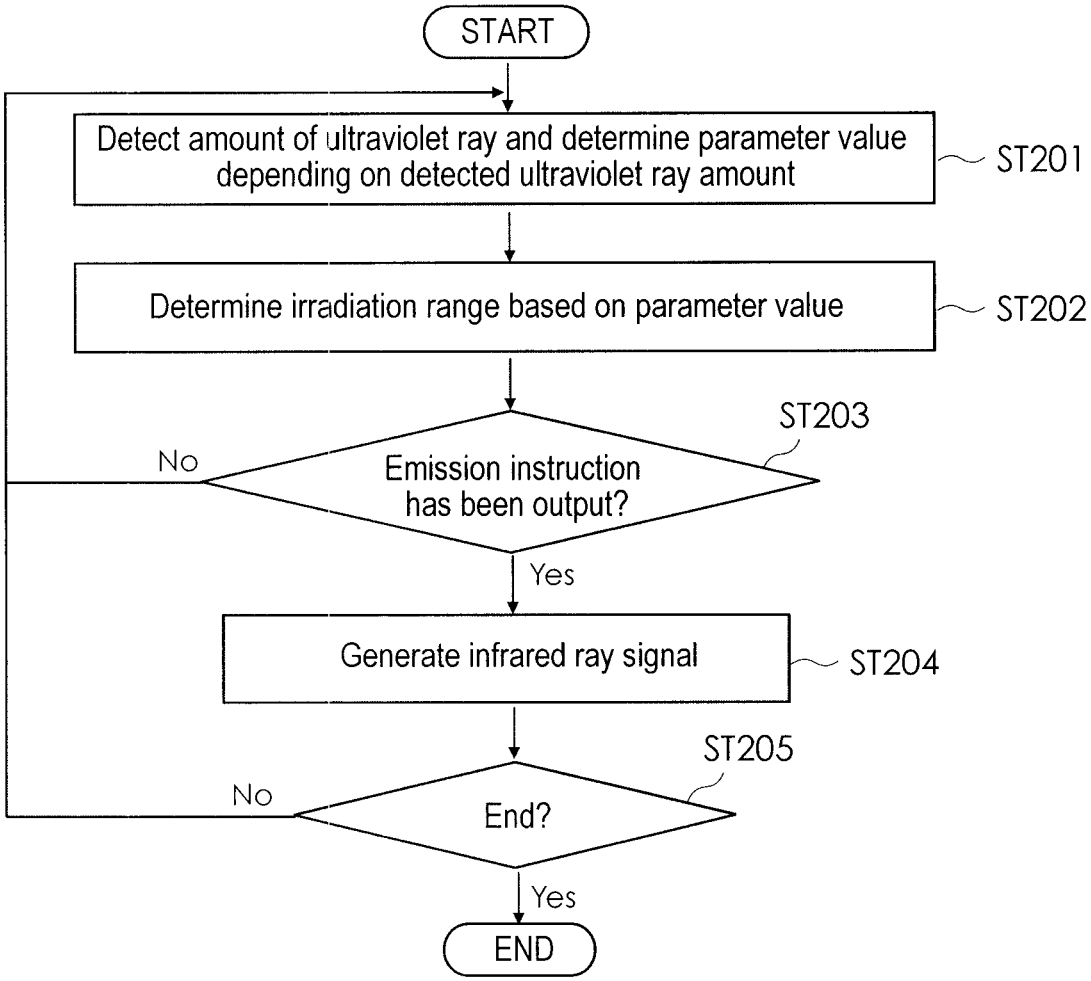
FIG. 8 is a flowchart showing an algorithm of a program used for changing the irradiation range of the infrared ray signal.

FIG. 8 is a flowchart showing an algorithm of software used for changing the irradiation range of the infrared ray signal so as to change the intensity of the infrared ray signal to be generated. The ultraviolet ray detector 27 detects the amount of the ultraviolet ray around the ray gun toy 1. The ultraviolet ray detector 27 detects the ultraviolet ray constantly, and the ultraviolet ray amount determining section 33 consecutively receives an electrical signal from the ultraviolet ray detector 27 and determines the amount of the ultraviolet ray. Then, the ultraviolet ray amount determining section 33 determines a parameter value based on the amount of the ultraviolet ray detected (step ST201). The ultraviolet ray amount determining section 33 then determines the irradiation range of the infrared ray signal based on the parameter value (step ST202*a*), and the irradiation range controlling section 37 controls the irradiation range of the infrared ray (step ST202*b*). Then, it is determined whether an emission instruction has been output (step ST203). The processing from step ST203 to step ST205 is the same as the Processing from step ST3 to step ST5 of FIG. 4, and the description thereof is omitted here.

Figure 9:
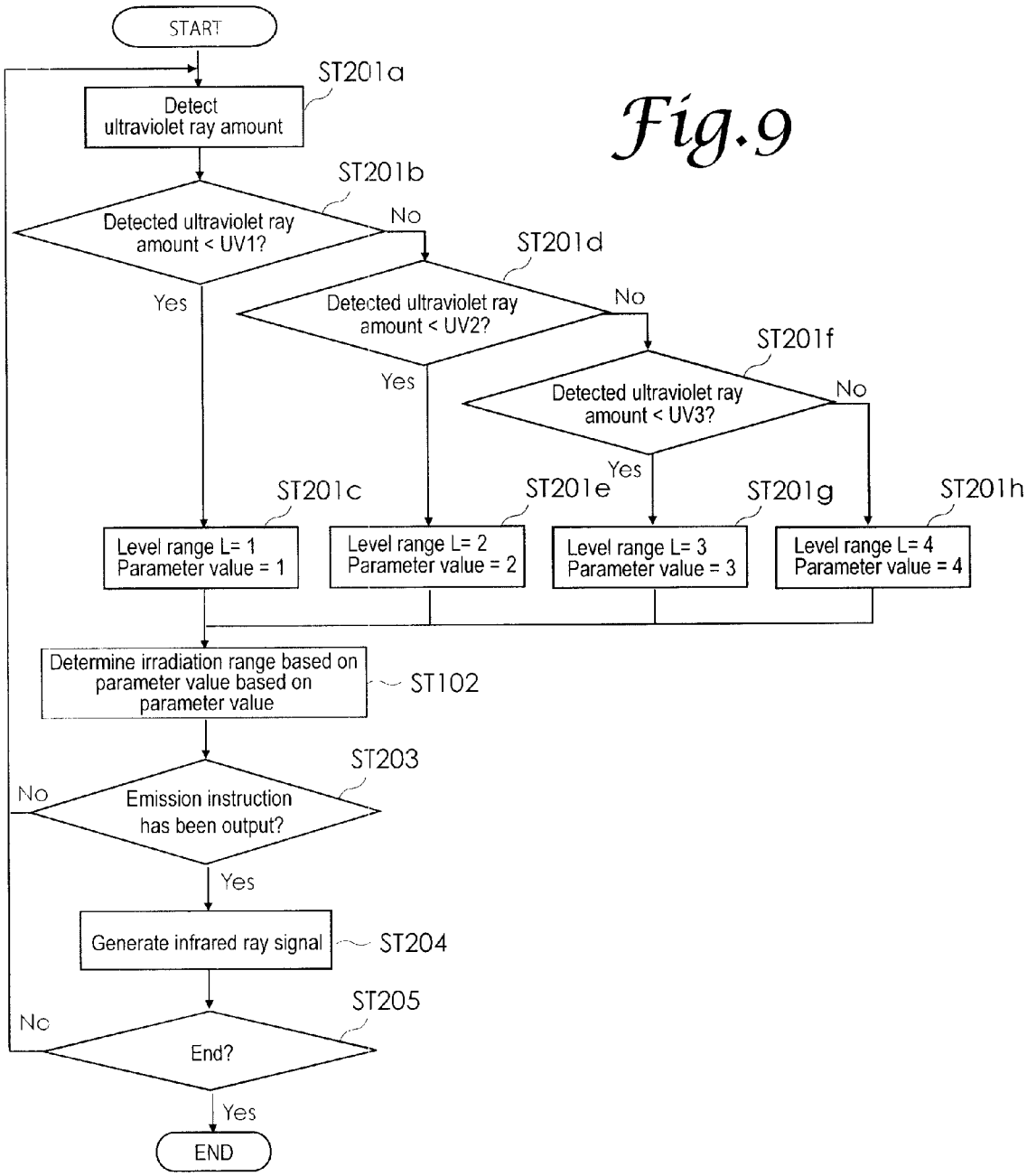
FIG. 9 is a flowchart for explaining a part of the flowchart of FIG. 8 in more detail.

FIG. 9 is a flowchart for explaining in more detail the algorithm of FIG. 8, wherein in step ST201, it is determined to which one of two or more level ranges that have previously been set the amount of the ultraviolet ray detected by the ultraviolet ray detector 27 belongs and the parameter value for changing the irradiation range of the infrared ray depending on the determined level range is determined. It is assumed here that the irradiation range controlled by the irradiation range controlling section 37 is divided into four levels. In step ST201*a*, the ultraviolet ray detector 27 detects the amount of the ultraviolet ray around the ray gun toy 1. In step ST201*b*, it is determined whether the amount of the ultraviolet ray detected is less than a prescribed ultraviolet ray amount UV1.

When the amount of the ultraviolet ray is less than the UV1, the level range of the intensity of the ultraviolet ray is determined to be 1 (L=1), and the parameter value is set to 1 (step ST201*c*). When the amount of the ultraviolet ray is not less than the UV1, the flow advances to step ST201*d*. In step ST201*d*, it is determined whether the amount of the ultraviolet ray detected is less than a prescribed ultraviolet ray amount UV2. When the amount of the ultraviolet ray is less than the UV2, the level range of the intensity of the ultraviolet ray is determined to be 2 (L=2), and the parameter value is set to 2 (step ST201*e*). When the amount of the ultraviolet ray is not less than the UV2, the flow advances to step ST201*f*. In step ST201, it is determined whether the amount of the ultraviolet ray detected is less than a prescribed ultraviolet ray amount UV3. When the amount of the ultraviolet ray is less than the UV3, the level range of the intensity of the ultraviolet ray is determined to be 3 (L=3), and the parameter vaLue is set to 3 (step ST201*g*). When the amount of the ultraviolet ray is not less than the UV3, the flow advances to step ST201*h*, where the level range of the intensity of the ultraviolet ray is determined to be 4 (L=4), and the parameter value is set to 4. In step ST202, the irradiation range of the infrared ray is determined based on the parameter value corresponding to the determined level range. Concretely, the irradiation range is determined such that the larger the parameter value is, the narrower the irradiation range of the infrared ray Above three algorithms shown in FIGS. 4 and 5, FIGS. 6 and 7, and FIGS. 8 and 9 may be used independently or in proper combination.

Although the ray gun toy 1 according to the present embodiment is a short barrel pistol, the present invention can be applied to a ray gun toy of a rifle type having a long barrel or a machine gun type Although the ultraviolet ray region is set as the wavelength region of light to be detected in the present embodiment, a visible light region or infrared ray region may be set as the wavelength region of light to be detected. In this case, an illuminance sensor or infrared ray sensor may be used as an optical sensor.

As each embodiment described above, detection of the intensity of the light included in a particular wavelength region around the ray gun toy can be reflected in the determination of the intensity of the infrared ray signal to be generated, the number of the infrared ray generating element to be driven, and/or irradiation range of the infrared ray. This allows a ray gun of an opponent player to reliably receive the infrared ray signal in the shooting game even under an outdoor environment or under an environment where the incandescent light is used. As a result, the players can enjoy the shooting game even in an open air, e.g., under a scorching sun or under an environment where the incandescent light is used.

INDUSTRIAL APPLICABILITY

According to the present invention, the intensity of the infrared ray signal to be generated is changed in accordance with the intensity of the ambient light included in a particular wavelength region. Thus, even if the shooting game is played in an open air, e.g., under a scorching sun, it is possible to reliably transmit the infrared ray signal to a shooting toy of an opponent player as in the case where the shooting game is played under an indoor environment.

The invention claimed is:

1. A shooting toy used in a game for two or more players comprising:

an infrared ray signal generating section that generates an infrared ray signal for shooting;

an infrared ray signal receiving section that receives an infrared ray signal generated by a shooting toy of a different player; and an optical sensor that detects an intensity of light included in a particular wavelength region and outputs a detection result, the infrared ray signal generating section including a plurality of infrared ray generating elements disposed to emit the infrared ray in the same direction and a driving device that selectively drives the infrared ray generating elements;

the driving device of the infrared ray signal generating section being configured to increase or decrease the number of infrared ray generating elements to drive according to the output from the optical sensor.

2. The shooting toy used in a game for two or more players according to claim 1, wherein the driving device increases or decreases the number of the infrared ray generating elements to drive according to an increase or decrease in intensity of the light included in the particular wavelength region detected by the optical sensor.

3. The shooting toy used in a game for two or more players according to claim 1, wherein the driving device determines which level range an intensity of the light included in the particular wavelength region falls in among predetermined two or more level ranges, and increases the number of the infrared ray generating elements to drive according to the determined level range.

4. The shooting toy used in a game for two or more players according to claim 1, wherein the infrared ray signal generating section further includes an irradiation range controlling section that controls an irradiation range of the infrared ray signal; and the irradiation range controlling section is configured to control the irradiation range of the infrared ray signal according to the output from the optical sensor.

5. The shooting toy used in a game for two or more players according to claim 4, wherein the irradiation range controlling section narrows the irradiation range when the intensity of the light included in the particular wavelength region detected by the optical sensor increases, and widens the irradiation range when the intensity of the light included in the particular wavelength region detected by the optical sensor decreases.

6. The shooting toy used in a game for two or more players according to claim 4, wherein the irradiation range controlling section determines which level range an intensity of the light included in the particular wavelength region falls in among predetermined two or more level ranges, and narrows the irradiation range according to the determined level range.

7. The shooting toy used in a game for two or more players according to claim 1, wherein the optical sensor is an ultraviolet ray detector including an ultraviolet ray sensor, and the light included in the particular wavelength region is ultraviolet ray.

8. The shooting toy used in a game for two or more players according to claim 1, wherein the optical sensor is an illuminance sensor, and the light included in the particular wavelength region is visible light.

9. A shooting toy used in a game for two or more players comprising:

an infrared ray signal generating section that generates an infrared ray signal for shooting;

an infrared ray signal receiving section that receives an infrared ray signal generated by a shooting toy of a different player; and an optical sensor that detects an intensity of light included in a particular wavelength region and outputs a detection result, the infrared ray signal generating section including an irradiation range controlling section that controls an irradiation range of the infrared ray signal; and the widening or narrowing of the irradiation range controlling section being configured to control the irradiation range of the infrared ray signal according to the output from the optical sensor.

10. The shooting toy used in a game for two or more players according to claim 9, wherein the irradiation range controlling section narrows the irradiation range when the intensity of the light included in the particular wavelength region detected by the optical sensor increases, and widens the irradiation range when the intensity of the light included in the particular wavelength region detected by the optical sensor decreases.

11. The shooting toy used in a game for two or more players according to claim 9, wherein the irradiation range controlling section determines which level range an intensity of the light included in the particular wavelength region falls in among predetermined two or more level ranges, and narrows the irradiation range according to the determined level range.

12. The shooting toy used in a game for two or more players according to claim 9, wherein the optical sensor is an ultraviolet ray detector including an ultraviolet ray sensor, and the light included in the particular wavelength region is ultraviolet ray.

13. The shooting toy used in a game for two or more players according to claim 9, wherein the optical sensor is an illuminance sensor, and the light included in the particular wavelength region is visible light.

14. A shooting toy used in a game for two or more players comprising:

an infrared ray signal generating section that generates an infrared ray signal for shooting;

an infrared ray signal receiving section that receives an infrared ray signal generated by a shooting toy of a different player; and an optical sensor that detects an intensity of the light included in a particular wavelength region and outputs a detection result, the infrared ray signal generating section including a plurality of infrared ray generating elements disposed to emit the infrared ray in the same direction and a driving device that selectively drives the infrared ray generating elements, the infrared ray signal generating section being configured to increase or decrease an intensity of the infrared ray signal and the number of infrared ray generating elements to drive according to the output from the optical sensor.

15. The shooting toy used in a game for two or more players according to claim 14, wherein the infrared ray signal generating section increases or decreases an intensity of the infrared ray signal according to an increase or decrease in intensity of the light included in the particular wavelength region detected by the optical sensor.

16. The shooting toy used in a game for two or more players according to claim 14, wherein the infrared ray signal generating section determines which level range an intensity of the light included in the particular wavelength region falls in among predetermined two or more level ranges, and increases or decreases an intensity of the infrared ray signal according to the determined level range.

17. The shooting toy used in a game for two or more players according to claim 14, wherein the optical sensor is an ultraviolet ray detector including an ultraviolet ray sensor, and the light included in the particular wavelength region is ultraviolet ray.

18. The shooting toy used in a game for two or more players according to claim 14, wherein the optical sensor is an illuminance sensor, and the light included in the particular wavelength region is visible light.

* * * * *